United States Patent [19]

Gresillon

[11] 4,059,973

[45] Nov. 29, 1977

[54] CIRCULAR KNIT LOWER BODY GARMENT AND METHOD OF MANUFACTURE

[75] Inventor: Robert Gresillon, Colroy la Grande, France

[73] Assignee: Prenihan AG, Zurich, Switzerland

[21] Appl. No.: 605,526

[22] Filed: Aug. 18, 1975

Related U.S. Application Data

[63] Continuation of Ser. No. 335,893, Feb. 29, 1973, abandoned.

[30] Foreign Application Priority Data

Apr. 28, 1972 France ..... 72.15303
Nov. 16, 1972 France ..... 72.40673

[51] Int. Cl.[2] ..... A41B 9/02
[52] U.S. Cl. ..... 66/177
[58] Field of Search ..... 66/174–177

[56] References Cited

U.S. PATENT DOCUMENTS

| | | | |
|---|---|---|---|
| Re. 27,886 | 1/1974 | Johnson | 66/177 |
| 3,595,034 | 7/1971 | Safrit | 66/177 |
| 3,748,870 | 7/1973 | Fregeolle | 66/177 |
| 3,815,385 | 6/1974 | Gariboldi | 66/172 R |

FOREIGN PATENT DOCUMENTS

| | | | |
|---|---|---|---|
| 1,246,499 | 9/1971 | United Kingdom | 66/177 |

*Primary Examiner*—Ronald Feldbaum
*Attorney, Agent, or Firm*—Robert B. Frailey

[57] ABSTRACT

The invention relates to a method of manufacturing, by continuous unidirectional rotary knitting, of one-piece bifurcated lower body garments, of the type having a pair of legs, such as tights, leotards, panty hose, body stockings and the like, and of the legless type, such as briefs, panties, panty girdles, batching suits and the like. The invention provides a one-piece rotary knit garment having an elasticated waistband which is formed during the knitting of the garment, and comprises an integral part thereof. By reason of this invention, it no longer is necessary to sew or affix a separate waistband to the garment following its knitting and removal from the knitting machine. The waist opening of the garment preferably also is formed while the garment is being rotary knitted on the machine, although the invention contemplates that the waist opening may be formed subsequent to the removal of the garment from the machine. If desired, additional rotary knit fabric may be added to the garment during knitting, between the waistband and the pants, to provide a waist extension.

16 Claims, 17 Drawing Figures

CIRCULAR KNIT LOWER BODY GARMENT AND METHOD OF MANUFACTURE

CROSS-REFERENCE TO OTHER APPLICATION

This application is a continuation of my pending U.S. patent application Ser. No. 335,893, filed Feb. 26, 1973, entitled "A Method of Knitting Integral Tights or Briefs of the Same Type as the Pants of Integral Tights on a Circular Knitting Loom."

DEFINITIONS

In this application, the following terms shall have the meanings indicated:

The terms "pressing off" and "press off" indicate the shedding or discharge of a loop of yarn from the needle on which the loop had been formed.

The term "elastomeric yarn" is synonymous with the term "elastic yarn," and indicates any yarn having an inherent capacity to elongate under tension, and having an inherent tendency to contract from an elongated condition with a degree of power in contraction. Such yarns include, as is well known in the art, yarns of synthetic rubber or other elastomers, such as spandex yarns and yarns made of other types of elastic polymers, and yarns of natural rubber (see, for example, U.S. Pat. Nos. 2,623,031, 2,946,210, Re. 25,046 and 3,937,039).

The term "elasticated waistband" indicates a knitted waistband incorporating elastomeric yarn in whole or in part, thereby rendering the knitted fabric elastic or elasticized.

BACKGROUND OF THE INVENTION

This invention relates to improvements in the knitting of bifurcated lower body garments by continuous unidirectional rotary knitting from one end of the garmet blank to the other end. In the case of two-legged garments, such as tights, leotards, panty hose, body stockings and the like, the garmet is rotary knit throughout, beginning with the tip of the toe of one leg and ending with the tip of the toe of the other leg, in the manner disclosed in Johnson U.S. Pat. No. Re. 27,886. The invention also is applicable to the continuous unidirectional rotary knitting of legless bifurcated garments, such as briefs, panties, panty girdles, bathing suits and the like which embody the same construction as the pants portion of the two-legged garments. The garments include waist openings having elasticated waistbands, and are provided with pants which have a greater number of courses in the upper portion than in their crotch portion.

In the known methods of knitting bifurcated lower body garments of this general type, an opening in the tubular fabric may be formed during knitting of the garment blank on the knitting machine. Following removal of the tubular blank from the machine, a separate waistband then is added to the opening, usually by sewing, to complete the waist portion of the garment.

The aforesaid method of applying the waistband to the garment, following its removal from the knitting machine, is disadvantageous. The application of the separate waistband must be performed with a high degree of accuracy in order to ensure a proper fitting garment. The separate application of a waistband to the garment requires the cutting away and rejection of material or fabric from the garment in the waist area. If excessive, this causes an unsatisfactory reduction in the length of the article, whereas the cutting away of too small a quantity of reject material or fabric may cause excessive slackening of the knitted garment when worn.

SUMMARY OF THE INVENTION

The primary object of the invention is to provide a bifurcated lower body garment, either with or without legs, which avoids the necessity of separately sewing or affixing a waistband to the garment, following its removal from the knitting machine. With this invention, the waistband is knitted integrally with the fabric of the garment of the knitting machine.

To this end, and in accordance with a first embodiment of the invention, the waistband is knitted as an integral part of the garment following the knitting of the first half of the tubular blank. In accomplishing this, a selected number of needles are put out of action, by interrupting the supply of yarn thereto, but are permitted to retain their stitches. An elastomeric yarn is supplied to the remaining active needles, which knit a first portion of the waistband of partial courses. Thereupon, at least a portion of the active needles knitting the first portion of the waistband press off their stitches to form the waist opening of the article. Following pressing off, elastomeric yarn again is fed to the active needles, to knit the second waistband portion of partial courses. During the knitting of the two waistband portions of partial courses, the yarn is trimmed automatically close to the edges of the fabric, to avoid the presence of floats in the garment. After both waistband portions have been knitted, all of the needles are put back into action to knit the second half of the garment.

In the case of the knitting of bifurcated garments having legs, such as tights, the knitting begins and ends with the formation of the toe area of a leg, whereas in the case of legless bifurcated garments, such as briefs, the operation is begun and completed by the formation of a knitted elastic edge or band in the leg areas of the garment.

In one mode of operation, after the first waistband portion has been knit, all of the stitches are pressed off from the needles, following which the second waistband portion is knitted. In this embodiment, the two portions of the waistband are separated from each other upon the removal of the garment from the knitting machine. It then is necessary to complete the garment by sewing the two portions of the waistband together.

In another mode of operation, the aforesaid sewing operation is dispensed with and the waistband is completed of integrally knit, elasticated fabric during knitting on the machine. To accomplish this, following knitting of the first waistband portion, the stitches on only the intermediate needles actively knitting yarn are pressed off, and the stitches are retained on selected needles which form the two ends of the first waistband portion. Following pressing off of the stitches of the intermediate needles, knitting of the second waistband portion begins. By this arrangement, the two waistband portions are integrally joined together at their opposite ends to provide an integral, elasticated waistband and a waist opening formed therein during the continuous, rotary knitting of the garment blank on the machine.

In another embodiment of the invention, a first portion of the pants of the garment is knit, including the first portion of the fabric comprising the waistband. Thereupon, a selected number of needles, corresponding to the width of the waist opening, are taken out of action, and no yarn is fed thereto, while rotary knitting of the pants continues. After completion of the waist opening, all of the needles are put back into action and the remaining waistband fabric is knit, followed by the knitting of the remainder of the garment. During the knitting of the waistband fabrics and the formation of the waist opening, elastomeric yarn is fed to selected needles to produce an integral, elasticated waistband. During formation of the waist opening, the yarn is trimmed automatically close to the edges of the fabric, to avoid the presence of yarn floats.

A better understanding of the invention will be gained from a perusal of the following description and from a study of the accompanying drawing, in which several modes of operation of the method of the invention, and the garments produced thereby, are shown by way of example, without any limitation being implied.

DETAILED DESCRIPTION OF THE INVENTION

Figure 1:
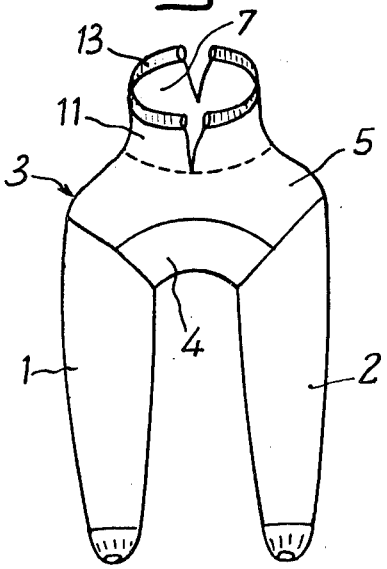
FIG. 1 shows diagrammatically in perspective an integral pair of tights with the pant portion provided with an extension below the waistband.
Figure 4:
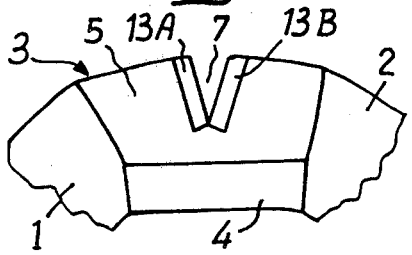
FIGS. 4–7 show a modification of the garment illustrated in FIGS. 1–3, in which the extension below the waistband has been eliminated.

The integral pair of tights shown in FIG. 1 is formed of two legs, 1, 2 joined together by pants 3, composed of a crotch 4 and an upper portion 5. The complete pair of tights is knit as a tubular blank by continuous, unidirectional rotary knitting, beginning with the lower end of the leg 1 and ending with the lower end of the leg 2, in the manner disclosed in the Johnson U.S. Pat. No. Re. 27,886 aforesaid.

The crotch 4 of the pants 3 is provided with a smaller number of courses than the upper portion 5. This may be accomplished by the introduction of spaced partial courses in the upper portion 5, during circular knitting of the pants 3, to provide a greater arcuate or axial length of fabric in the portion 5 than in the crotch 4. The waist opening 7, including the waist extension 11 and the waistband 13, are formed laterally during knitting of the tubular blank, by means of intermediate knitting operations above the upper portion 5 of the pants 3. The dash line shown in FIGS. 1 and 2 indicates where waist extension 11 is joined integrally with the upper portion 5 of the pants 3 of the garment.

More specifically, the initial operation consists of knitting the leg 1, which is either open or closed at the toe, in accordance with any suitable and conventional rotary knitting technique. The first half portion of the pants 3, namely that portion which is shown on the left-hand side of FIG. 2, then is rotary knitted. The portion 5A of the upper pant portion 5 is provided with a greater number of courses than the portion 4A of the crotch 4, for example, by rotary knit part coursing.

After pant portions 4A, 5A have been knitted, a selected number of needles of the knitting machine are put out of action by interrupting the supply of yarn thereto, while nevertheless permitting them to retain their stitches. The needles selected to be inactive may be raised to an inoperative or holding position above the stitch cams of the machine, in the manner suggested in U.S. Pat. Nos. 2,511,720 2,560,580 and 3,748,870. The remaining needles are maintained in their lowered or active position, so as to continue to knit fabric during rotation of the needle cylinder. By way of example, in the case of a 400 needle machine, a continuous arc of 200 needles are raised out of action. The continuous arc of needles which remain in operation are employed, during continued rotation of the needle cylinder, to knit the half portion 11A of the waist extension 11 of the pants 3. Fabric extension portion 11A is rotary knit of partial courses integrally with, and as a continuation of, fabric portion 5A of the upper portion 5 of the pants 3. To prevent the formation of yarn floats between the side edges of the fabric portion 11A, the yarn is trimmed automatically during knitting close to the fabric edges in a well known manner.

The presence of the fabric extension 11 provides a remedy for the usual lack of adequate fit of the pants of the garment, which generally results from a lack of sufficient height of fabric in the waist portion. This problem is made worse by the cutting off of the reject material or fabric at the time when a separate waistband is sewn or otherwise applied to the garment.

When the height or length of the fabric portion 11A of the extension 11 is sufficient, the first half 13A of the waistband 13 then is formed. The waistband portion 13A also is knit in partial courses by rotary knitting, as a continuation of fabric extension portion 11A. During knitting of the waistband portion 13A, an elastomeric yarn is fed to the needles. The waistband portion 13A may be knit of single ply fabric or, if desired, it may be knit of double ply fabric in the same manner as a conventional stocking welt or a conventional knitted waistband or a pair of tights. The knitted fabric of the waistband portion 13A may be turned over, to form a double ply fabric, as a result of the action of the transfer jacks or of the needles of the machine, as is well known. If the waistband portion 13A is knit of single ply fabric, any well known run-resistant or ravel-resistant stitch construction may be selected in order to prevent possible unstitching of the fabric.

Following knitting of the partial waistband 13A, all of the stitches on the active needles, are pressed off to form the waist opening 7 in the garment. The inactive needles continue to retain their stitches and remain inactive. Following pressing off of their stitches, the active needles again are fed elastomeric yarn, to knit the second half 13B of the waistband portion 13. In commencing the knitting of the waistband portion 13B, any known mode of make-up may be employed to start knitting of the fabric on the bare active needles. Waistband portion 13B also is rotary knit of partial courses, and is of identical construction to waistband portion 13A. Following knitting of waistband portion 13B, fabric extension portion 11B is rotary knit on the active needles, of the same number of partial courses as compose fabric portion 11A.

Fabric portion 11B is knit down to the dash line shown in FIG. 1, where waist extension 11 joins upper pants portion 5. At this juncture, all of the needles of the knitting machine again are put into action, and knitting of the crotch portion 4B and the upper pant portion 5B takes place during continuous rotary knitting, to form the second half of the pants 3. This again is carried out by means of part coursing, to provide a greater number of courses in the upper pant portion 5B than in the crotch portion 4B. Following knitting of the second half of the pants 3, the garment is completed by knitting the leg 2 in the identical, but reverse order in which leg 1 was knitted.

Figure 3:
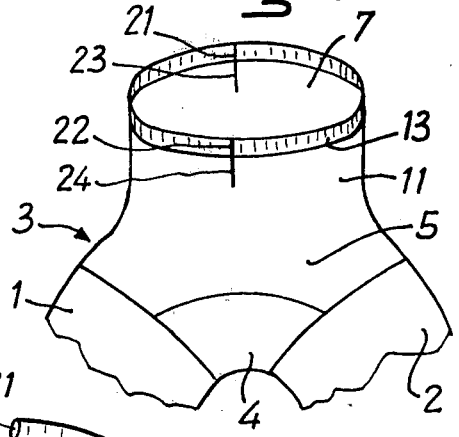
FIG. 3 shows the upper portion of the garment of FIG. 1 after the two portions of the waist opening have been sewn together.

By reason of the method of knitting of this invention, it no longer is necessary to sew or otherwise apply a separate waistband to the garment, since the waistband 13 is knitted integrally with the garment during knitting of the tubular blank on the knitting machine. Following knitting of the garment, all that remains to be done to complete the garment is to sew together, by conventional sewing stitches, the waistband portions 13A and 13B at edges 21 and 22 (FIG. 2), and to sew together the two halves 11A and 11B of the extension 11 at edges 23 and 24. FIG. 3 shows the upper portion of the garment in completed condition, with the extension 11 of the pants 3 and the waistband 13 united by sewing stitches at 23, 24 and 21, 22, respectively.

Figure 2:
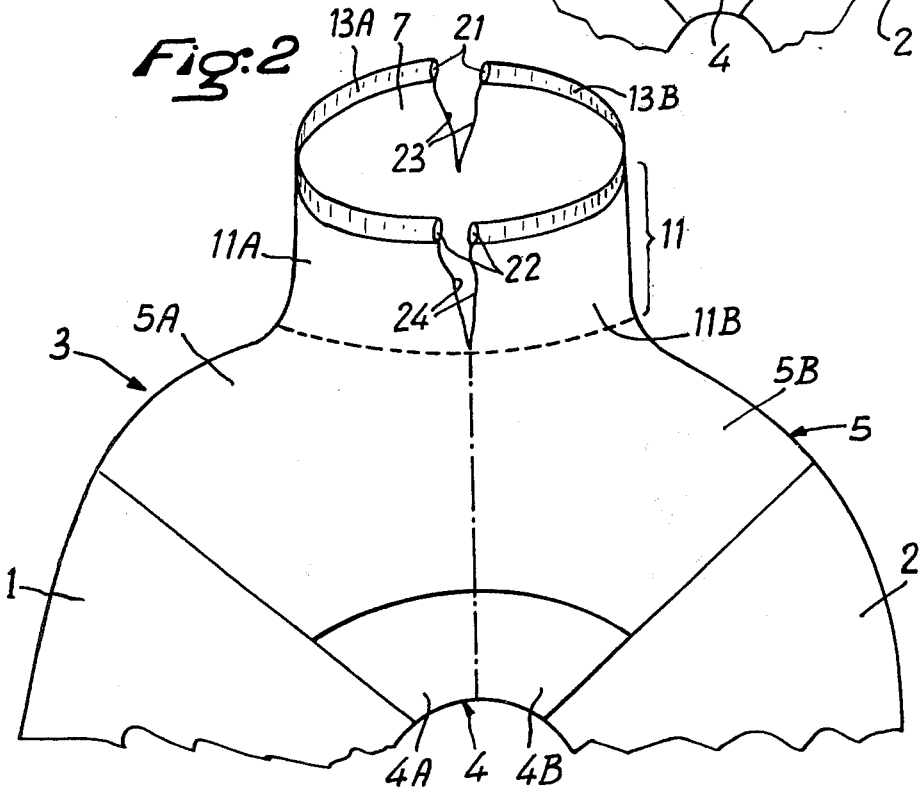
FIG. 2 shows on a larger scale the details of the upper portion of the garment of FIG. 1 prior to sewing the two portions of the waist opening together.
Figure 5:
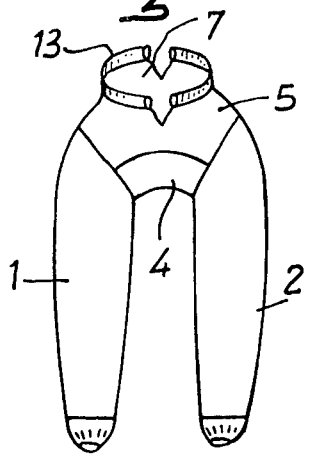
Figure 6:
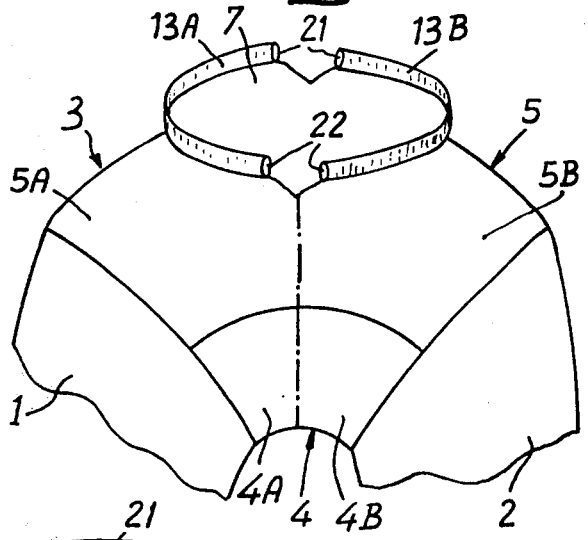
Figure 7:
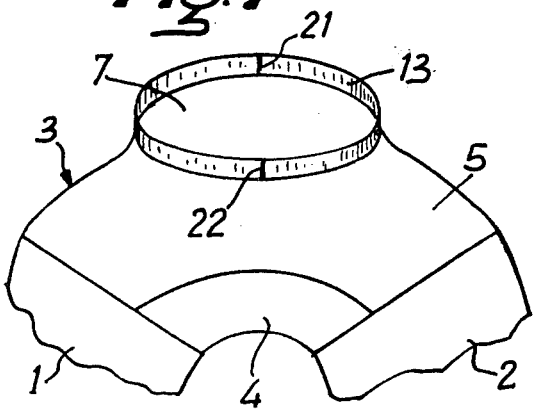

The method of manufacture of the integral tights shown in FIGS. 4–7 is similar to that of the tights shown in FIGS. 1–3. The only difference is that the garment of FIGS. 4–7 is not provided with the waist extension 11 interposed between the pants 3 and the waistband 13. FIG. 6 shows the details of the process and construction involved in the manufacture of the upper central portion of the garment. The same reference numerals are used in FIG. 6 as are employed in FIG. 2, to designate the corresponding portions of the two garments. FIG. 7 shows the completed upper portion of the tights illustrated in FIGS. 4–6.

In the garment of FIGS. 4–7, the initial half portion of the pants 3, composed of upper portion 5A and crotch portion 4A, first is knit on all needles of the machine, by continuous rotary knitting, with partial courses being formed in the upper portion 5A. Thereupon, a selected number of needles are put out of action by being raised to an inoperative, stitch holding position, while the remaining needles remain in the lower position for active knitting. The waistband portion 13A of the garment then is knit, in the manner previously described in respect to the garment shown in FIGS. 1–3, of elastomeric yarn.

After waistband portion 13A has been knit, the stitches of the active needles are pressed off to form the waist opening 7. Following pressing off, the active needles again are fed elastomeric yarn, to knit the second half 13B of the waistband. After knitting of the waistband portion 13B, all of the needles of the knitting machine again are put into action, and the knitting of the crotch portion 4B and the upper pant portion 5B takes place during continuous rotary knitting, to complete the pants 3.

If desired, yarns of different materials may be employed for knitting the pants 3 of the tights than are used for knitting the legs 1 and 2 thereof.

Figure 9:
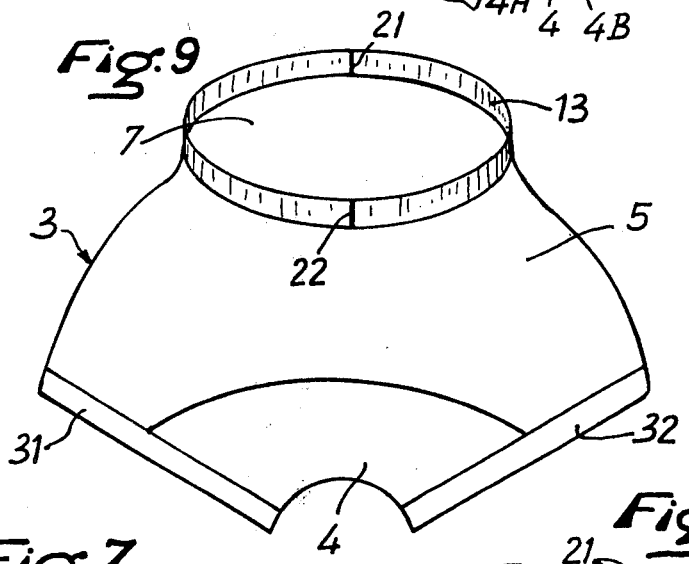
FIG. 9 shows the garment of FIG. 8 after the two portions of the waist opening have been sewn together.
Figure 8:
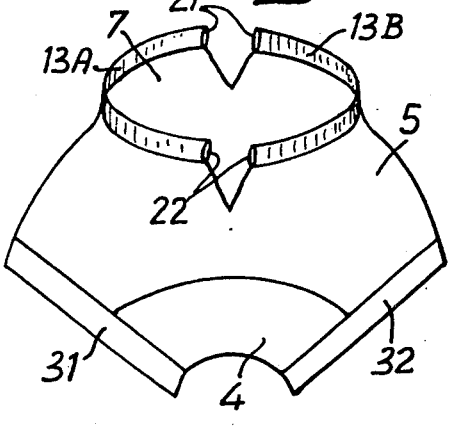
FIG. 8 shows diagrammatically in perspective an integral pair of briefs constructed in accordance with the pant portion of the garments of FIGS. 4–7, prior to sewing the two portions of the waist opening together.

As shown in FIGS. 8 and 9, the method of this invention may be utilized to knit a pair of briefs, rather than a pair of tights, by eliminating the legs 1 and 2 of the garment. In such case, the knitting of the garment would begin and end with the formation of knitted elastic bands 31 and 32, respectively, either of single ply or double ply fabric, serving as thigh edgings.

Seamless knit bifurcated two-legged garments, such as tights, leotards, panty hose, body stockings and the like, and seamless knit bifurcated legless garments, such as briefs, panties, panty girdles, bathing suits and the like, can be produced at a lower cost by the method of knitting of this invention than with conventional processes, where the waistband is separately sewn or affixed to the garment following its removal from the knitting machine. This result is realized since the waistband is formed integrally with the garment while it is being knit on the knitting machine.

If desired, the pants 3 of the garment can be knit with tuck loops for tightening the crotch in a predetermined zone or in selected zones. The garments may be made of dyed yarn, thereby dispensing with a subsequent dyeing operation following knitting.

Figure 10:
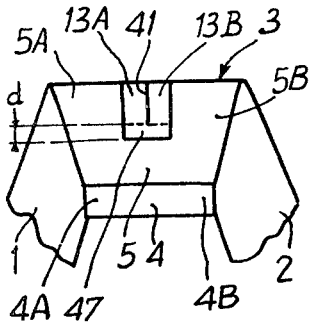
FIGS. 10–12 are fragmentary views showing a fourth modification of the invention.
Figure 11:
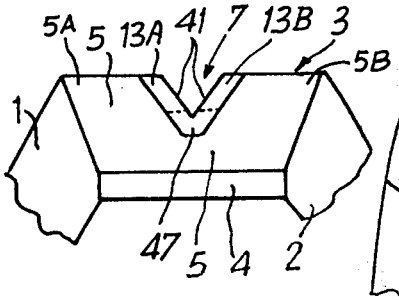
Figure 12:
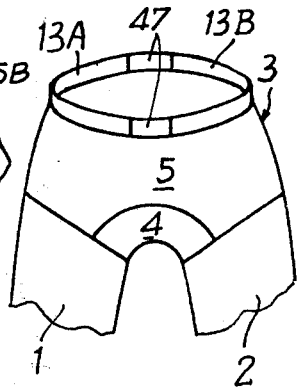

FIGS. 10–12 show the upper portion of another modified pair of integral tights made in accordance with this invention. The garment is shown as a flattened blank in FIG. 10, at an intermediate stage in FIG. 11 and as a finished garment in FIG. 12. It is composed of two legs, 1, 2, which are joined together by means of pants 3 having a crotch 4 and an upper portion 5. The pants 3 are rotary knit to provide spaced partial courses in the upper portion 5, so that the crotch 4 is composed of a smaller number of courses than the portion 5. The garment is knit as a tubular blank by continuous, unidirectional rotary knitting, beginning with the toe (not shown) of the leg 1 and ending with the toe (not shown) of the leg 2. The waist opening 7 (FIG. 11) is knit integrally with and laterally of the upper portion 5, by means of intermediate knitting operations performed during knitting of the pants 3.

In this case also, after the pant portions 4A, 5A have been knitted, a selected number of needles in a continuous arc are put out of action by interrupting the supply of yarn thereto, while nevertheless permitting them to retain their stitches. Preferably, half of the needles of the knitting machine are raised out of action, while the remaining arc of needles are maintained in active position, and knit fabric during the continued rotation of the needles. Elastomeric yarn now is fed to the active needles to rotary knit the first portion 13A of the waistband of the garment of partial courses.

Following knitting of the partial waistband 13A, only a portion of the arc of stitches on the active needles are pressed off to form the waist opening 7 in the garment. A selected number of needles, at each end of the group of active needles, retain their stitches while the stitches of the intermediate needles are pressed off. The active needles which do not have their stitches pressed off extend over a distance "*d*" at each end of the waistband portion 13A (FIG. 10). The inactive needles continue to retain their stitches and remain inactive. Following pressing off of the stitches of the intermediate active needles, elastomeric yarn again is fed to all of the active needles, to knit the second half 13B of the waistband. Waistband portion 13B also is rotary knit of partial courses, and is of identical construction to waistband portion 13A. The two waistband portions 13A, 13B are joined integrally to each other, at their respective ends, over the distances "*d*" aforesaid. An opening or separation 41 is formed between the two waistband portions 13A, 13B, over the greater portion of their lengths, to provide the waist opening 7. The separation 41 in the fabric occurs where the stitches were pressed off the intermediate active needles, and provides a notch in the fabric, forming the waist opening 7, generally similar in construction to the heel notches illustrated in U.S. Pat. Nos. 1,887,927, 2,111,472 and 2,115,672.

In commencing the knitting of the waistband portion 13B, any known mode of make-up may be employed to start knitting of the fabric on the bare active needles. During the make-up, yarn is fed only to the intermediate active needles, from which stitches had been pressed off. The waistband portions 13A and 13B may be knit of any well known run-resistant or ravel-resistant stitch construction, in order to prevent unstitching of their fabrics.

Following knitting of the waistband portion 13B, all of the needles of the knitting machine again are put into action, and the knitting of the crotch portion 4B and the upper pant portion 5B takes place during continuous rotary knitting, to complete the pants 3. During this period of knitting, partial courses are formed in the upper fabric portion 5B.

There is therefore obtained a pair of tights having two spaced waistband portions 13A, 13B which are integrally joined together at their opposite ends by means of the two intermediate knitted portions 47 (FIGS. 11, 12). The waistband fabric may be knit either of single ply fabric or double ply fabric, as desired, and according to the capabilities of the knitting machine employed. The knitting process illustrated and described with respect to the modification of FIGS. 10–12, described above, does not require the joining together of the two waistband portions 13A and 13B by sewing, since the waistband portions are joined integrally together during knitting by means of the two intermediate knitted portions 47.

Figure 13:
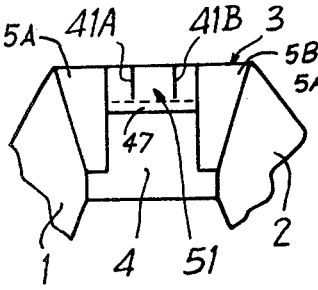
FIGS. 13–15 are fragmentary views showing a fifth modification of the invention.
Figure 14:
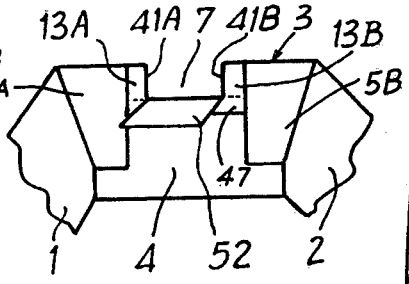
Figure 15:
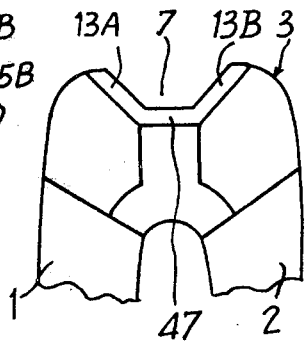

In FIGS. 13–15, there is shown yet another modification of a pair of integral tights made in accordance with this invention. The garment of FIGS. 13–15 is rotary knitted throughout on all needles, with none of the needles raised to inactive position at any time during the knitting.

As the pants 3 of this garment are knit, an arcuate stitch zone is formed with elastomeric threads composed of the fabric portions 13A, 51, 47, 13B (FIGS. 13, 14). The arcuate stitch zone may be similar in construction to the elastic arcuate crotch panel illustrated in Anderson U.S. Pat. No. 3,937,039. After the garment has been completely knitted and removed from the knitting machine, the elastic fabric zone is cut along the two coursewise spaced lines 41A and 41B to produce the intermediate reject material or fabric 52, which is trimmed from the garment. The finished garment is shown in FIG. 15, having a waistband composed of two spaced waistband fabric portions 13A and 13B, the respective opposite ends of which are joined by means of integrally knitted fabric portions 47, in the manner generally similar to that illustrated in FIG. 12. The waistband of the garment of FIGS. 13–17, composed of the fabric portions 13A, 47, 13B is constituted of a single thickness of elastic fabric.

Figure 16:
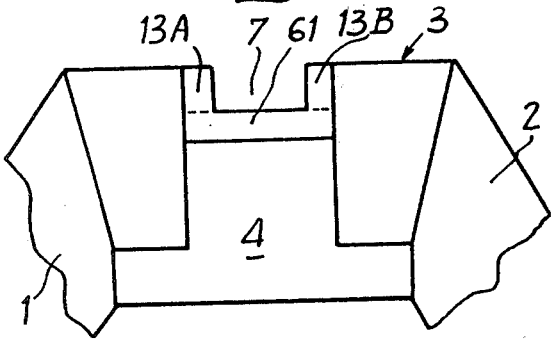
FIGS. 16–17 are fragmentary views showing a sixth modification of the invention.
Figure 17:
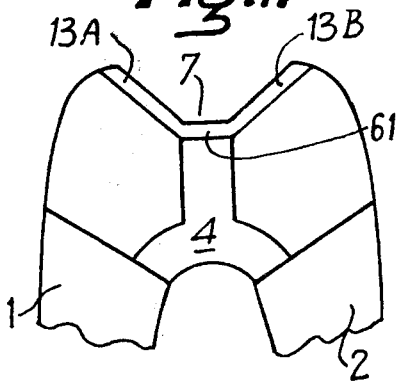

In the further modification shown in FIGS. 16 and 17, the elastic waistband portions 13A, 13B are joined together at their opposite ends by means of two integrally knitted elastic portions 61, in the manner generally illustrated in FIGS. 12 and 15. However, in the knitting of the garment of FIGS. 16 and 17, the waist opening 7 is formed during the knitting process, thereby rendering unnecessary the cutting and removal of reject material or fabric, as is required with the garment of FIGS. 13–15.

The garment of FIGS. 16 and 17 is formed by continuous, unidirectional rotary knitting, from the toe (not shown) of leg 1 through to the toe (not shown) of leg 2. During the knitting of the waistband portions 13A, 61, 13B, elastomeric yarn is fed to the needles knitting those fabric portions to produce elastic knit-in waistband fabric.

After the waistband portion 13A has been knitted, a selected number of needles, corresponding to the arcuate width of the waist opening 7, are taken out of action, and no yarn is fed thereto. The needles removed from action may be controlled to remain at welt level during knitting, or may be raised to inoperative position, so as to pass above the stitch cams of the knitting machine, in any manner well known in the art, for example, such as illustrated in U.S. Pat. Nos. 2,511,720, 2,560,580 and 3,748,870 aforesaid. During this phase of the knitting, the yarn is trimmed closely adjacent to the edges of the elastic fabric portions 61, disposed on each side of the waist opening 7, to eliminate the formation of floats in the fabric.

Following completion of the waist opening 7, all of the needles again are put into action and the waistband portion 13B and then the remaining portion of the pants 3 are knitted. Following knitting of the pants 3, the leg 2 is knitted, to complete the garment, with a waistband composed of the two spaced waistband fabric portions 13A and 13B joined at their opposite ends by knitted fabric portions 61.

In the modified garments of FIGS. 13–15 and 16–17, the pants 3 preferably are rotary knitted to provide spaced partial courses in the upper portions, so that their respective crotch portions 4 are composed of a smaller number of courses than their upper portions. Preferably, also, the waistbands of the garments of FIGS. 13–15 and 16–17 may be knit of any well known run-resistant or ravel-resistant stitch construction, to prevent unstitching or unraveling of their fabrics.

As is readily apparent, the invention is not limited to the embodiments and modes of operation hereinabove described with reference to the drawing. The invention is applicable to the knitting of all types of seamless knit bifurcated two-legged garments, such as tights, leotards, panty hose, body stockings and the like, and seamless knit bifurcated legless garments, such as briefs, panties, panty girdles, bathing suits and the like. Depending on the applications which are contemplated, modifications can be made to the invention hereof without departing from the scope or the spirit of the invention, as set forth in the appended claims.

I claim:

1. A method of knitting a seamless integral bifurcated lower body garment having pants and a waist opening provided with a waistband, by continuous unidirectional rotary knitting from one end of the garment to the other end on a knitting machine having a circle of needles, said method comprising the steps of:

a. knitting a first portion of the garment, b. removing a selected number of needles to inactive position, while permitting said needles to retain their stitches.

c. knitting an additional portion of the garment on the non-selected active needles, d. feeding elastomeric yarn to at least some of the active needles during knitting of the additional portion to form knitted elasticated fabric portions providing segments of an integral knitted elastic waistband, e. forming an opening in the garment during knitting of the additional portion to provide the waist opening, f. and, following knitting of the additional portion, putting the inactive needles back into action and knitting the remainder of the garment.

2. A method according to claim 1, further including the steps of:

a. knitting a first portion of the pants to provide an upper pants portion and a crotch portion, the upper portion containing a greater number of fabric courses than the crotch portion.

b. then knitting a second portion of the pants to provide an integral waistband and a second crotch portion, c. feeding elastomeric yarn to the needles knitting the waistband during knitting of the second portion of the pants, d. during knitting of the second portion of the pants, removing a selected number of needles to inactive position, to form a waist opening, e. and, following knitting of the second portion of the pants, putting the inactive needles back into action and knitting the remainder of the garment.

3. The method of claim 2, further including the step of knitting a third portion of the pants following knitting of the second portion of the pants to provide an upper pants portion and a crotch portion, the upper portion containing a greater number of fabric courses than the crotch portion.

4. A method according to claim 1, further including the steps of:

a. knitting a first half of the garment, b. then removing a selected number of needles to inactive position, while permitting said needles to retain their stitches, c. knitting a first integral waistband portion composed of partial courses on the non-selected active needles, d. following knitting of the first waistband portion, pressing off the stitches from at least a portion of the active needles, e. then knitting a second integral waistband portion composed of partial courses on the non-selected active needles, f. and, following knitting of the second waistband portion, putting the inactive needles back into action and knitting the remainder of the garment.

5. The method of claim 4, further including the step of feeding elastomeric yarn to the needles knitting the waistband portions.

6. A method according to claim 4, further including the steps of:

a. following knitting of the first waistband portion, pressing off the stitches from all of the active needles, b. then knitting the second waistband portion on all of the active needles, to provide spaced waistband portions separated from each other, and c. following knitting of the remainder of the garment, uniting the separated waistband portions to provide a unitary integral waistband for the garment.

7. A method according to claim 4, further including the steps of:

a. following removal of the selected needles to inactive position, knitting a first intermediate fabric portion on the non-selected active needles prior to knitting the first waistband portion, b. following knitting of the second waistband portion, knitting a second intermediate fabric portion on the non-selected active needles, c. said two intermediate fabric portions comprising components for a waist extension for the garment, d. and, following the knitting of the remainder of the garment, uniting the two intermediate fabric portions to complete the waist extension.

8. A method according to claim 4, further including the steps of:

a. removing a selected number of needles to inactive position, said needles comprising a continuous arc of needles of the circle of needles, b. knitting the first waistband portion on the arc of needles formed by the non-selected active needles, c. following knitting of the first waistband portion, pressing off the stitches from an intermediate arc of the arc of active needles, while permitting selected needles at each end of the arc of active needles to retain their stitches, d. and then knitting the second waistband portion on all of the active needles to provide an integral, continuous waistband in which the first and second waistband portions are joined at opposite ends by intermediate segments of knitted fabric.

9. The method of claim 8, further including the step of feeding elastomeric yarn to the needles knitting the waistband portions.

10. The method of claim 1, wherein the garment comprises a two-legged garment, and wherein the garment is rotary knit continuously from the toe end of one leg through to and including the toe end of the second leg.

11. The method of claim 1, wherein the garment is legless and is provided with leg openings defined by knitted elastic bands, and wherein the garment is rotary knitted continuously from the elastic band of one leg opening through to and including the elastic band of the other leg opening.

12. A seamless integral unidirectional rotary knitted bifurcated lower body garment having wales and courses therein, comprising:

a. a pants portion, b. a waist portion, c. said waist portion having a knit-in waist opening, said waist opening extending course-wise and wale-wise of the fabric and being defined by spaced, opposing stitches of the garment, d. and an elasticated waistband surrounding the waist opening, said waistband being integrally knit with the pants of the garment and including two wale-wise spaced waistband portions each incorporating elastomeric yarn and each having course-wise extending stitch edges.

13. The garment of claim 12, wherein the two spaced waistband portions are united by sewing stitches.

14. The garment of claim 12, wherein the two spaced waistband portions are united by intermediate knitted fabric portions formed integrally with each of the waistband portions.

15. The garment of claim 12, further including:

a. spaced seams extending up the front and the back of the garment uniting the two spaced waistband portions, b. a crotch area comprising part of the pants portion and c. a pair of leg portions connected integrally with the pants portion, d. said leg portions being joined integrally to each other by the crotch area.

16. A seamless integral unidirectional rotary knitted bifurcated lower body garment comprising a. a pants portion, b. a waist portion formd in the pants portion, c. said waist portion having a waist opening, said waist opening being defined by spaced, opposing stitches of the garment formed during knitting, d. an elasticated waistband surrounding the waist opening, said waistband including two waistband portions each incorporating elastomeric yarn, and each being integrally knit with the pants portion, e. seams extending up the front and back of the garment, uniting the two waistband portions, f. a pair of legs integrally knitted with and extending from the pants portion and g. a crotch area disposed in the pants portion and knitted integrally with each of the two leg portions of the garment.

* * * * *